United States Patent [19]

Hounsel et al.

[11] Patent Number: 4,584,814

[45] Date of Patent: Apr. 29, 1986

[54] METHOD AND APPARATUS FOR FASTENING AN INSULATION MODULE TO A SURFACE

[75] Inventors: Mack A. Hounsel, Cypress, Tex.; Anthony E. Cimochowski, Sedalia, Colo.

[73] Assignee: Manville Corporation, Denver, Colo.

[21] Appl. No.: 581,928

[22] Filed: Feb. 21, 1984

[51] Int. Cl.[4] ..... E04B 1/62; F23M 5/00

[52] U.S. Cl. ..... 52/747; 52/512; 52/506; 110/336; 110/331

[58] Field of Search ..... 52/506, 512, 747; 266/280, 283; 110/336, 331

[56] References Cited

U.S. PATENT DOCUMENTS

| | | | |
|---|---|---|---|
| Re. 22,108 | 6/1942 | Crecca | 52/506 |
| 2,021,610 | 11/1935 | Quint | 110/336 |
| 3,523,395 | 8/1970 | Rutter et al. | 52/506 |
| 3,604,492 | 9/1971 | Bayer | 52/512 |
| 3,687,093 | 8/1972 | Byrd, Jr. | 52/506 |
| 3,742,670 | 7/1973 | Byrd, Jr. | 110/336 |
| 3,892,396 | 7/1975 | Monaghan | 52/506 |
| 3,909,907 | 10/1975 | Davis | 52/249 |
| 3,940,244 | 2/1976 | Sauder et al. | 110/336 |
| 4,030,261 | 6/1977 | Coleman | 52/506 |
| 4,157,001 | 6/1979 | Pickles | 110/336 |
| 4,233,468 | 11/1980 | Northup, Jr. | 52/506 |
| 4,324,602 | 4/1982 | Davis et al. | 52/506 |
| 4,344,753 | 8/1982 | Shelley et al. | 110/336 |
| 4,379,382 | 4/1983 | Sauder | 52/506 |

FOREIGN PATENT DOCUMENTS

| | | | |
|---|---|---|---|
| 598438 | 4/1978 | Switzerland | 52/512 |

*Primary Examiner*—Carl D. Friedman
*Assistant Examiner*—Michael Safavi
*Attorney, Agent, or Firm*—John D. Lister; Cornelius P. Quinn; Timothy R. Schulte

[57] ABSTRACT

A method and apparatus for fastening an insulation module to a furnace wall. A stud member is welded onto the furnace wall. A pilot tool is attached to the stud member. An insulation module is impaled over the pilot tool and stud member. A nut is inserted onto the pilot member and threadably engages the stud member to secure the insulation module to the surface.

8 Claims, 6 Drawing Figures

METHOD AND APPARATUS FOR FASTENING AN INSULATION MODULE TO A SURFACE

BACKGROUND OF THE INVENTION

1. Field of the Invention

The invention relates to the field of static structures. More particularly, the invention relates to insulation modules attachable to a static structure. In still greater particularity, the invention is a method and apparatus for fastening an insulation module to the interior surface of a furnace. By way of further characterization, but not by way of limitation thereto, the invention includes a threaded stud welded to the surface with the insulation module threadably secured to the stud.

2. Description of the Related Art

Many methods in apparatus exist for attaching insulation modules to the inside of furnaces and the like. Previously, the insulation modules were attached by utilizing exterior hardware. That is, hangers or the like were employed and the insulating material was impaled thereon. Such a system is shown in U.S. Pat. No. 3,892,396. The use of hangers with individual insulating layers suffer from the disadvantage that each individual layer be placed on the hangers which is a time consuming process. In addition, the support provided by the hangers is less than desirable and the layers may tear away under stress. For these reasons, most insulation today is in the form of a prefabricated module which is attached to the furnace lining as opposed to individual layers.

Other systems, such as that shown in U.S. Pat. No. 3,523,395 employ members which are attached to the furnace lining with the insulating material impaled thereon. An exterior fastener, is then pushed into the insulating material and attached to the member which is secured to the wall of the furnace. While suited for their intended purposes, the above apparatus suffer from certain deficiencies in addition to those listed above. That is, if the supporting hardware is exposed to the interior of the furnace, heat from the furnace could cause failure of the hardware resulting in separation of the insulating material from the furnace lining.

The attachment of insulation modules to a furnace lining has been accomplished by attaching a stud or other member to the insulation module. The stud is passed through the wall of the furnace and secured from the outside of the furnace. While suited for its intended purpose, such an attachment means is not suited for all applications. In some situations it is desirable to have an attachment means to the inside of the furnace wall. In such situations, the welding or other attachment of the fastening means to the interior of the furnace wall is desirable. One such system, herein refered to as the "blind weld system", utilizes a stud welding gun which is inserted through the insulation module and held against the furnace wall. That is, the welding of the stud to the furnace wall is done through the insulation module with a nut or other fastening means then used to attach the module to the stud. One major disadvantage of such a system is that the stud must be welded to the furnace wall without visual observation by the welder. Thus, faulty or improper welds cannot be observed. The result is that failures can occur which result in the insulation modules being separated from the furnace wall.

SUMMARY OF THE INVENTION

The invention is a method in apparatus for attaching insulation modules to a furnace wall in which a stud may be welded to the furnace wall and then the module attached thereto. The attachment hardware is contained internally in the insulation module such that degredation due to contact of the fastening hardware with internal furnace heat is eliminated. The method includes attaching a pilot tool to the stud after it has been welded to the furnace wall and impaling the insulation module over the pilot tool and the stud. The module is then attached to the stud by an engaging member which is passed over the pilot tool and onto the stud.

In the preferred embodiment, the stud comprises a threaded member including a larger first threaded portion and a second smaller threaded portion. The larger first threaded portion is welded to the furnace wall. The pilot tool is threaded onto the second threaded portion and the insulation module is impaled thereon. Portions of the insulation material around the pilot tool and stud may be pushed aside to allow ease of access to the fastening hardware. A nut is passed over the pilot tool and onto the first threaded portion of the stud. A socket wrench or other suitable tool is then used to torque the nut down against the module thereby securing the module to the furnace wall.

DESCRIPTION OF THE PREFERRED EMBODIMENT

Figure 1:
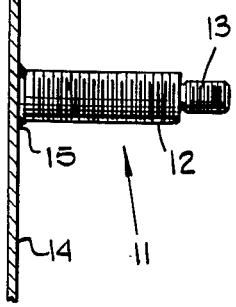
FIG. 1 shows the stud member welded to the furnace wall.

Referring to FIG. 1, stud member 11 includes a first larger threaded portion 12 and a second smaller threaded portion 13. Stud member 11 is shown attached to a furnace wall 14 by a weld 15.

Figure 2:
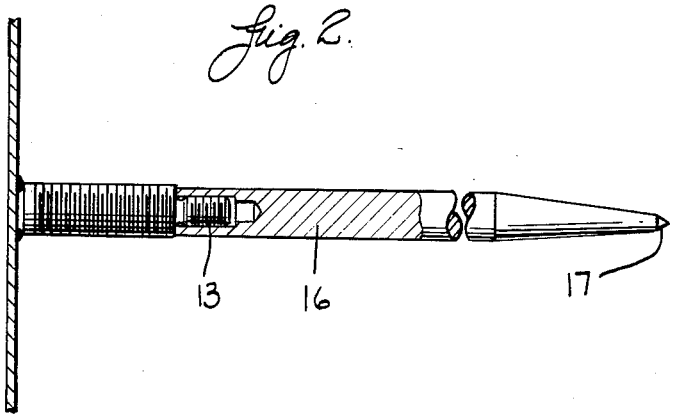
FIG. 2 illustrates the pilot tool connected to the stud member.

Referring to FIG. 2, a pilot tool 16 is shown threadably engaged with second threaded portion 13. A pointed end 17 is included on pilot tool 16.

Figure 3:
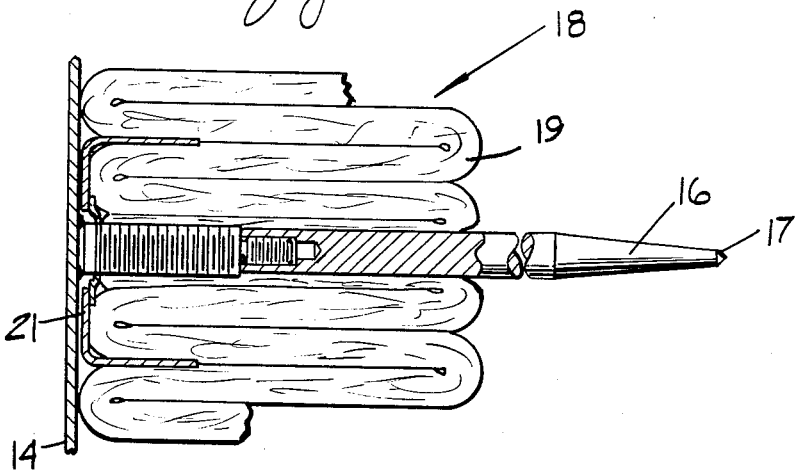
FIG. 3 shows the insulation module impaled onto the pilot tool and stud member.

Referring to FIG. 3, an insulation module 18 is impaled on pilot tool 16 and stud 11 so as to be adjacent furnace wall 14. Insulation module 18 includes refractory fiber blanket 19 and mounting hardware 21. A complete description of one example of an insulation module 18 may be found in U.S. Pat. No. 4,381,634 issued to M. A. Hounsel et al. on May 3, 1983. This patent is hereby incorporated into this specification by reference and made a part hereof. It should be expressly understood that the invention herein may be employed with a variety of insulation modules and it is not to be limited to the module referred to above.

Figure 4:
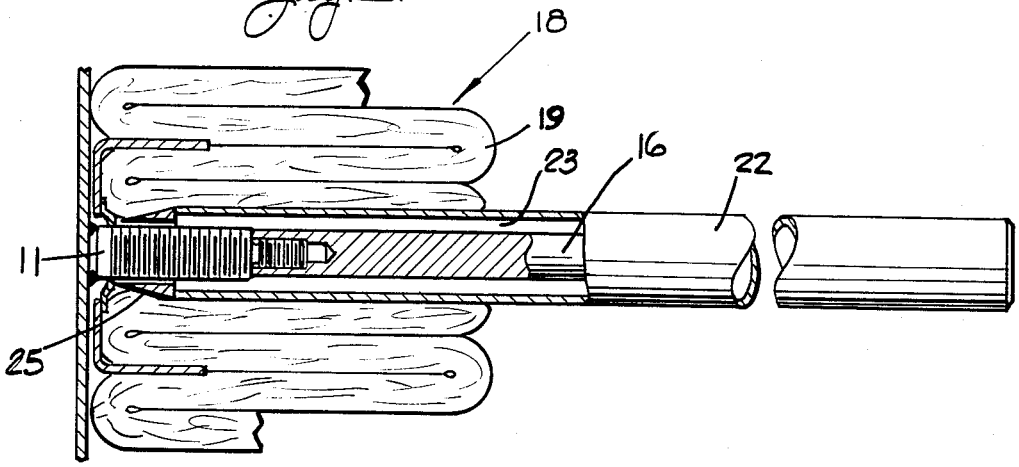
FIG. 4 shows a wedging tool used to remove insulating fiber from around the stud member and pilot tool.

Referring to FIG. 4, a wedge tool 22 is used to separate insulation material 19 from pilot tool 16 and stud 11. That is, wedge tool 22 is hollow and fits over pilot tool 16 and stud 11. Wedge tool 22 is slightly larger in diameter than stud 11. Wedge tool 22 includes a beveled portion 25 which forces blanket 19 in insulation module 18 away from stud 11 and pilot 16. Upon removal of wedge tool 22, blanket 19 moves back toward the area adjacent stud 11 and pilot tool 16 but does not come into contact with them leaving an open space 23.

Figure 5:
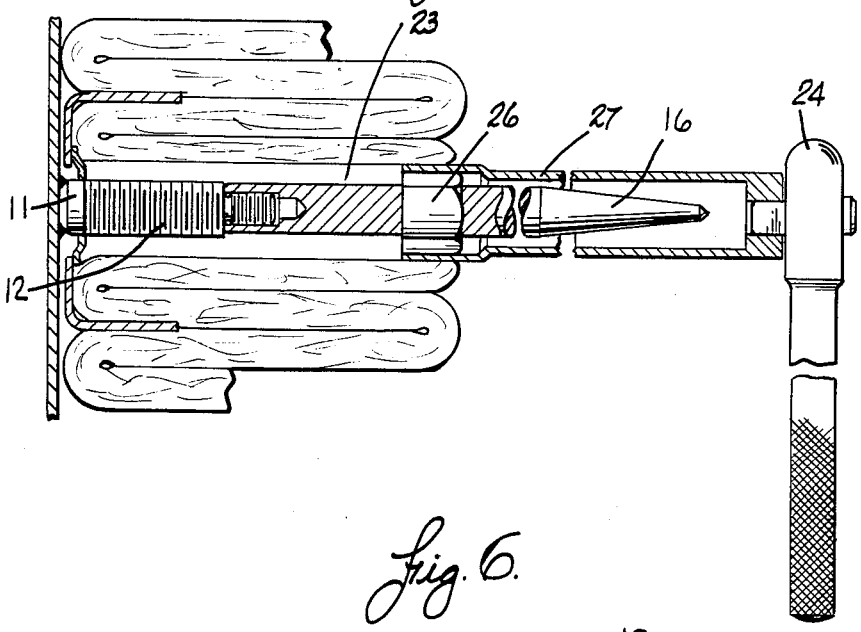
FIG. 5 shows the nut being passed over the pilot tool and onto the stud member.

Referring to FIG. 5, a nut 26 is held in a deep socket apparatus 27 with a ratchet 24 such that nut 26 may be threadably attached to first threaded portion 12 of stud 11. Nut 26 and socket 27 are moved over pilot tool 16 in an open space 23 left by the wedging of insulation 19.

Figure 6:
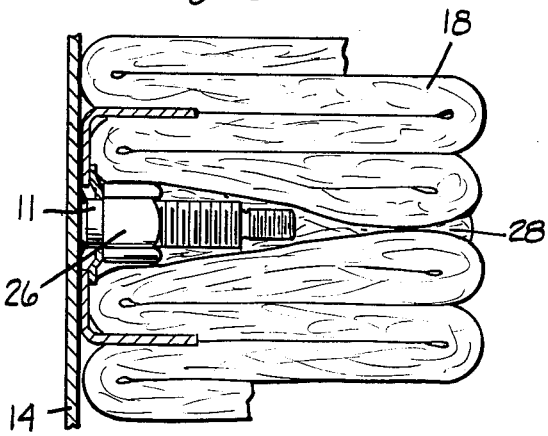
FIG. 6 shows the insulation module attached to the furnace wall.

Referring to FIG. 6, insulation module 18 is attached to furnace wall 14 by nut 26 which has been torqued against module hardware 21 thereby holding it against furnace wall 14. The pilot tool has been removed and a plug 28 of insulating fiber has been placed into the hole created by wedge 22 in FIG. 4.

MODE OF OPERATION

Referring to FIG. 1, stud 11 is welded to furnace wall 14 by conventional apparatus. This allows the weld to be visually inspected and the stud to be flexed if necessary to determine the strength of weld 15. While welding is preferred, the joining of stud member 11 to furnace wall 14 may be accomplished by other suitable methods.

Referring to FIG. 2, pilot tool 16 is connected to stud member 11. The connection of pilot tool 16 to stud member 11 may be accomplished by threading pilot tool 16 onto second threaded portion 13 of stud member 11 such that it bottoms against first threaded portion 12. This prevents flexing and breaking off of second threaded portion 13.

Referring to FIG. 3, insulation module 18 is impaled over point 17 on pilot tool 16 and onto stud member 11 such that insulation module hardware 21 rests adjacent furnace wall 14. As stated above, insulation module 18 may be a module such as that disclosed in U.S. Pat. No. 4,381,634 which has been incorporated herein by reference.

Referring to FIG. 4, flexible insulation material 19 will necessarily be adjacent stud member 11 and pilot tool 16 after the module 18 has been impaled thereon. In order to allow ease of installation it may be desirable to separate insulation material 19 from stud member 11 in order that nut 26 may be threadably engaged with stud member 11. Thus, wedge tool 22 may be used to separate insulation 19 from the area adjacent stud member 11 and pilot tool 16. Beveled portion 25 separates a portion of insulation from blanket 19 as wedge tool 22 is passed over pilot tool 16 and driven down against module 18. Upon being withdrawn, the area around stud member 11 and pilot tool 16 is clear of any refractory fiber material leaving open space 23 around stud member 11. In some situations it may be preferable to remove the insulation immediately surrounding stud 11. This may be accomplished by a coring tool or other suitable means for removing the insulation.

Referring to FIG. 5, the ratchet 24 and socket mechanism 27 may be utilized to attach nut 26 to first threaded portion 12. That is, the apparatus may be inserted over pilot tool 16 and into the area 23. Nut 26 may then be threaded onto first threaded portion 12 and the conventional ratchet 24 or other mechanism used to torque nut 26 against hardware 21 such that module 18 is held to stud member 11 and against furnace wall 14 as shown in FIG. 6. The outside diameter of pilot tool 16 is such that it is slightly less than the inside diameter of nut 26. Thus nut 26 is guided into contact with first threaded portion 12 and because nut 26 is prevented from tilting, cross threading is avoided. After the fastening of module 18 to furnace wall 14, a plug of refractory fiber material 28 may be inserted into the open space 23 left by the removed insulating material 19. It should be expressly understood that the pushing aside of or removal of the insulating material 19 is not a required step and that it is done for ease of installation only. Because the refractory fiber 19 is flexible, it is preferable to push the fiber out of the way prior to engaging nut 26 on stud member 11. In addition, when all modules are installed, the pressure from adjacent modules will also tend to close up the open space 23.

While the invention has been disclosed with respect to a preferred embodiment thereof, it is not to be so limited as changes and modifications may be made which are within the full intended scope of the invention as defined by the appended claims. For example, while stud member 11 has been disclosed as welded to the furnace wall, it should be noted that any means of joining stud member 11 to furnace wall 14 may be employed. In addition, while pilot tool 16 has been shown to be threaded onto stud member 11, it should be noted that any means of connecting pilot tool 16 to stud member 11 may be employed. For example, stud member 11 could have a hollowed out square portion into which pilot tool 16 is inserted. Similarly, while a nut 26 has been disclosed to engage with stud member 11, it should be noted that other types of attaching devices may be employed to fasten module 18 to stud 11 and against furnace wall 14. As noted above, the use of wedge tool 22 to push aside insulating fiber 19 for ease of access to stud member 11 along with the resulting use of plug 29 of refractory material is optional depending upon installation procedures.

The foregoing description taken together with the appended claims, constitutes a disclosure which enables one skilled in the art in having the benefit of the teachings contained therein to make and use the invention. Further, the structure herein described constitutes a meritorious advance in the art which is unobvious to such skilled workers not having the benefit of the teachings contained herein.

What is claimed is:

1. Method for fastening an insulation module against a surface comprising the steps of:

joining a first end of a stud member to said surface;

connecting a pilot tool to a second end of said stud member opposite to said first end;

impaling said insulation module onto said pilot tool and said stud member;

passing an engaging member over said pilot tool and into contact with said stud member; and attaching said engaging member to said stud member and against said module so as to secure said module against said surface.

2. Method according to claim 1 wherein said step of joining includes welding said first end to said surface.

3. Method according to claim 1 wherein said step of connecting includes threadably connecting said pilot tool to said second end.

4. Method according to claim 1 wherein said step of attaching includes threadably attaching said engaging member to said stud member.

5. Method according to claim 1 further including, after said step of impaling, the step of wedging aside a portion of insulation material adjacent to said stud member and said pilot tool.

6. Method according to claim 5 further including the step of inserting a plug of insulating material after said step of attaching.

7. Method according to claim 1 wherein said stud member includes a first threaded end and a second threaded end, said first threaded end being larger in diameter than said second threaded end.

8. Method according to claim 7 wherein the aforesaid pilot tool is threadably engaged with said second threaded end, said pilot tool having a diameter less than the diameter of said first threaded end.

* * * * *